US008490670B2

(12) United States Patent
Miller

(10) Patent No.: US 8,490,670 B2
(45) Date of Patent: Jul. 23, 2013

(54) BUILD-OUT DOWELS FOR ROLLING PROTECTIVE SHUTTERS

(75) Inventor: James V. Miller, Glen Ellyn, IL (US)

(73) Assignee: Qualitas Manufacturing, Inc., Itasca (IL)

( * ) Notice: Subject to any disclaimer, the term of this patent is extended or adjusted under 35 U.S.C. 154(b) by 522 days.

(21) Appl. No.: 12/692,140

(22) Filed: Jan. 22, 2010

(65) Prior Publication Data

US 2010/0181029 A1 Jul. 22, 2010

Related U.S. Application Data

(60) Provisional application No. 61/146,459, filed on Jan. 22, 2009.

(51) Int. Cl.

| | |
|---|---|
| ***E06B 9/08*** | (2006.01) |
| ***E06B 9/17*** | (2006.01) |
| ***A47H 3/00*** | (2006.01) |

(52) U.S. Cl.

USPC ..... 160/133; 160/266

(58) Field of Classification Search

USPC ..... 160/133, 238, 239, 266, 267.1, 268.1, 160/270, 371; 29/525.01; 403/223, 293; 49/57; 52/202

See application file for complete search history.

(56) References Cited

U.S. PATENT DOCUMENTS

| | | | | |
|---|---|---|---|---|
| 1,918,415 | A | | 7/1933 | Miller |
| 2,449,264 | A | | 9/1948 | Wilkinson |
| 3,269,455 | A | | 8/1966 | Gillotti |
| 3,668,808 | A | | 6/1972 | Perina |
| 4,068,428 | A | | 1/1978 | Peterson, III |
| 4,856,575 | A | * | 8/1989 | Wells ..... 160/353 |
| 5,575,322 | A | | 11/1996 | Miller |
| 5,657,805 | A | | 8/1997 | Magro |
| 5,850,862 | A | | 12/1998 | Miller |
| 5,938,136 | A | | 8/1999 | Miller |
| 5,975,185 | A | | 11/1999 | Miller et al. |
| 5,983,971 | A | | 11/1999 | Miller et al. |
| 5,996,669 | A | | 12/1999 | Miller |
| 6,012,260 | A | | 1/2000 | Hendrick et al. |
| 6,021,837 | A | | 2/2000 | Miller |
| 6,054,921 | A | | 4/2000 | Miller |
| 6,085,822 | A | | 7/2000 | Miller |
| 6,095,224 | A | | 8/2000 | Miller |
| 6,095,225 | A | | 8/2000 | Miller |
| 6,244,325 | B1 | | 6/2001 | Miller et al. |
| 6,263,942 | B1 | | 7/2001 | Miller |
| 6,302,179 | B1 | | 10/2001 | Miller |
| 6,374,551 | B1 | | 4/2002 | Boilen et al. |
| 6,422,289 | B1 | | 7/2002 | Miller |

(Continued)

*Primary Examiner* — Katherine Mitchell
*Assistant Examiner* — Jeremy Ramsey
(74) *Attorney, Agent, or Firm* — Miller, Matthias & Hull LLP

(57) ABSTRACT

An improvement in a rolling shutter assembly for covering an opening of a structure having an external protective surface, an underlying support structure and a subsurface disposed therebetween. The rolling shutter assembly includes a shutter housing, a shutter support member rotatably disposed within the shutter housing, a shutter coupled to the shutter support member, and a pair of side tracks. The improvement includes a plurality of dowels and corresponding openings through the external protective surface configured to receive the dowels. The dowels are disposed between the subsurface of the wall and the side tracks when the rolling shutter assembly is installed to minimize the portion of the external protective surface that is removed to accommodate the installation of the shutter assembly.

21 Claims, 5 Drawing Sheets

U.S. PATENT DOCUMENTS

| | | | | |
|---|---|---|---|---|
| 6,453,975 | B2 | 9/2002 | Miller | |
| 6,532,702 | B1 * | 3/2003 | Scribner | 52/202 |
| 7,413,000 | B2 | 8/2008 | Lin | |
| 2002/0108325 | A1 | 8/2002 | Hulls et al. | |
| 2005/0082020 | A1 | 4/2005 | Miller | |
| 2005/0205221 | A1 | 9/2005 | Miller | |
| 2005/0205222 | A1 | 9/2005 | Miller | |
| 2005/0205223 | A1 | 9/2005 | Miller | |
| 2006/0118251 | A1 | 6/2006 | Miller | |
| 2007/0028536 | A1 | 2/2007 | Pandorf | |
| 2007/0056696 | A1 | 3/2007 | Lin | |
| 2007/0175603 | A1 | 8/2007 | Lin | |
| 2007/0227093 | A1 * | 10/2007 | Penzkofer | 52/578 |

* cited by examiner

BUILD-OUT DOWELS FOR ROLLING PROTECTIVE SHUTTERS

CROSS-REFERENCE TO RELATED APPLICATIONS

This application claims the benefit of priority to U.S. Provisional Patent Application No. 61/146,459, filed on Jan. 22, 2009, entitled "Build-Out Dowels for Rolling Protective Shutters," which is hereby expressly incorporated by reference herein.

BACKGROUND

The patent is directed to shutters, and more particularly to a rolling protective shutter and build-out dowels for fastening the rolling protective shutter about an opening of a wall having an uneven surface.

Hurricane protection is desired more and more by business owners, home owners and municipalities, and the engineering and testing requirements for such protection are becoming increasingly stringent and rigorous. Many different solutions have been implemented in the attempt to protect structures from the varying forces and conditions associated with hurricanes. For example, openings for windows, doorways, porches and the like require protection from the forces created by the severe winds associated with the hurricanes that cause positive pressure pressing against the openings on the windward side of the structure, and negative pressure pulling outwardly from the opening on the leeward side of the structure.

One attempted solution for protecting openings is the installation of panels attached to the surrounding support structure of the building defining the opening such that the opening is essentially isolated from the surrounding environment. The panel configured to cover an opening defined by the surrounding structure, and having a window or door disposed therein. The panel has a plurality of openings around the perimeter of the panel configured to receive fasteners that will anchor the panel to the surrounding structure on the both sides and above and below the opening. The panels are fabricated from material that may withstand the conditions present during the hurricane, such as metal, plywood, fabric and the like.

As an alternative to such panels, rolling protective shutters have been implemented for protection openings during hurricanes for many years. FIG. 1 illustrates an example of a rolling protective shutter 30 configured to cover an opening 12 defined by a surrounding structure 14 and having a window 16 disposed therein. The rolling protective shutter 30 may be permanently attached to the structure 14 surrounding the opening 12, and include deployment mechanisms for quickly rolling and unrolling the shutter curtain. The shutter assembly 30 has a shutter housing which includes a top wall 32, a pair of side walls or end caps 34, and a front wall 36. A shutter support member 40 is mounted for rotation within the shutter housing. The support member 40 includes a generally cylindrical central shaft 42 and a plurality of mounting members 44 fixed to the shaft 42. The upper end of a rolling shutter 50 is coupled to the mounting members 44. The shutter 50 is composed of a plurality of individual, elongate slats 52 interconnected by hinges 54. The ends of the slats 52 are disposed within a pair of shutter tracks or side tracks 60.

The illustrated shutter assembly 30 has a gearbox 62 which interconnects the rotatable shaft 42 with a hand crank 64 via a conventional gear assembly (not shown). When mounted to protect a window or other opening, the shutter tracks 60 of the shutter assembly 30 are positioned on either side of the opening and attached to the walls with fasteners, and the shutter housing is positioned over the top of the opening. Alternatively, in some applications, the side tracks 60 and shutter housing are positioned within the opening. When the shutter 50 is not in use, it is rolled up on the shutter support member 40 via the hand crank 64 so that it is at least partially enclosed by the shutter housing. The hand crank 64 may be disposed on a rear portion of the shutter assembly 30 so that the shutter 50, when attached over a window for example, can be unrolled from inside the window. Alternatively, when the gearbox 62 is not provided, the support member 40 may include a torsion spring. The shutter 50 may be rolled and unrolled with the assistance of the tension in the spring by exerting a force on a bottommost slat 66 by grasping a handle 68 that extends longitudinally along the slat 66 and outwardly from the shutter 50. Other drive mechanism, such as straps, tubular operators and motors are well known in the art and are used to open and close rolling shutters.

To prevent the shutter curtain 50 from pulling out of the side tracks 60 and to increase the capacity of the shutter curtain 50 to withstand pressure loading during extreme conditions, end retention systems have been developed to hold the two ends of the slats 52 captive within the side tracks 60. FIGS. 2 and 3 illustrate an example of the shutter slats 52 and corresponding side track 60, respectively, configured to retain the ends of the slats 52 within the side track 60 when forces tend to cause the shutter curtain 50 to bow. Referring to FIG. 2, each slat 52 includes a double-wall slat portion 82, and is arc-shaped to facilitate rolling the shutter curtain onto the shutter support member 20. Each slat 52 further includes an elongated socket 84 integrally formed along the bottom edge 85 of the slat portion 82. A rod 86 is integrally formed along the top edge 87 of the slat portion 82. The rod 86 includes a groove or channel formed therein and running along the longitudinal length of the rod 86 to form an integral screw boss 88. The combined rod 86 and screw boss 88 approximate the shape of a second, smaller socket integrally formed on the edge 87 of the slat portion 82. The slats 52 are typically fabricated from extruded aluminum or polyvinyl chloride, but other materials and fabrication methods are known in the art.

The slats 52 are fabricated such that the inner diameter of the socket 84 is slightly larger than the outer diameter of the rod 86. The shutter curtain is assembled by sliding the rod 86 of one slat 52 into the socket 84 of the adjacent slat 52. The slats 52 are oriented with their concave surfaces on the same side of the shutter curtain so that the curtain rolls up properly onto the shutter support member 40. When the slats 52 are assembled, the rods 86 are pivotal within the sockets 84 to facilitate movement of the shutter curtain between the rolled and unrolled positions. Since the sockets 84 cover over half the diameter of the rods 86, the rods 86 are permanently retained within the sockets 84. The sockets 84 and rods 86 are configured to form a hinge that allows the connected slats 52 to rotate between a first position in which the sockets 84 and the rods 86 of the slats 52 are substantially linearly aligned, and a second position wherein the slat portions 82 combine to define an arc.

Once the shutter curtain is assembled, extension members 90 are attached to the screw bosses 88. The extension members 90 are adapted to keep the slats 52 vertically aligned and to captivate the shutter curtain within the side tracks 60 to prevent the shutter curtain from pulling out of the side tracks 60 during either an attempted break in or extreme wind conditions. Each of the extension members 90 has an inner flange 92 and an outer flange 94 separated by a neck 96 having a smaller diameter than the flanges 92, 94. Each extension member 90 further includes a threaded shank 98 that is dimensioned to correspond to the screw boss 88. The extension members 90 are attached to the shutter curtain by screwing the shanks 98 into the screw bosses 88 so that the extension members 90 are attached to both ends of a given screw boss 88.

The extension members 90 extend outwardly from the shutter curtain and the outer flanges 94 are captivated by the side tracks 60, as shown in FIG. 3, and prevent the shutter curtain from being pulled out of the shutter tracks 60. Each side track 60 has a pair of side walls 102, 104, and an end wall 106. The side track 60 further includes a pair of fins 112, 114 that extend inwardly from the side walls 102, 104, respectively, and define a gap 116 wide enough to receive the neck 96 of the extension member 90. The neck 96 of the extension member 90 extends through the gap 116 so that the outer flange 94 is disposed on the opposite side of the fins 112, 114 from the inner flange 92 and slat 52. The diameter of the outer flange 94 is larger than the gap 116 between the fins 112, 114 so that the outer flange 94 cannot be pulled through the gap 116. When the shutter curtain is subjected to a force perpendicular to its surface, the slats 52 bow and the ends of the slats 52 move toward the opening in the side tracks 60. As the slats 52 bow, the outer flanges 94 of the extension members 90 are engaged by the fins 112, 114 of the side track 60 to retain the ends of the slats 52 within the side track 60. Similarly, the slats 52 bow inwardly when sufficient positive pressure is applied to the shutter curtain.

Other examples of slats for rolling shutter curtains configured to receive retention mechanisms for retaining the ends of the shutter curtains within the side tracks can be found in U.S. Pat. No. 6,095,224, entitled "Shutter Tracks for Rolling Protective Shutters," U.S. Pat. No. 6,095,225, entitled "Shutter Slat with Integrated Screw Boss," and U.S. Patent Publication No. 2005/0205221 A1, entitled "Dual Boss Shutter Slat with Retention Plate," the entire disclosures of which are incorporated herein by reference. In each case, retention members are connected to the ends of the slats of shutter curtains, and the side tracks are configured to engage the retention members and retain the ends of the slats within the side tracks.

The shutters may be attached to the exterior surfaces 14 of buildings substantially as described above where the exterior surface 14 is substantially flat and there is no outwardly extending framing around the opening, or other obstructions such as door handles, hinges and the like. On such surfaces, the panel or shutter may be mounted flush against the surface via the fasteners, and the surface need only be pierced by holes that are large enough to receive the fasteners. In many installations, however, the shutters must be installed on various types of exterior surfaces that are not substantially flat and do not allow the shutters to be mounted flush against the surface. Consequently, exterior material such as shingles, siding, stucco and dryvit, for example, result in uneven surfaces in general and at the openings around which the shutters are to be mounted. For example, FIG. 4 illustrates an opening 200 having a window 202 surrounded by an upstanding window frame 204 in a wall 206 having an exterior surface consisting of siding planks 208. Such walls 206 typically have a subsurface secured to the support structure or framing of the building and the external protective surface in the form of the siding 208 installed over the subsurface. The siding 208 protects the subsurface from the elements and is installed in a manner to keep wind, rain, snow and other types of weather away from the subsurface to preserve the integrity of the wall. Moreover, the adjoining surfaces of the siding 280 and the window frame 204 are sealed to further protect the subsurface in areas that may otherwise leak.

While the construction materials causing the uneven surfaces protect the subsurface, they do not provide an adequate surface and structure for mounting shutters 30 thereto. The materials typically do not have sufficient strength to support the shutters 30, even where the shutters 30 are mounted through the exterior layer and into the subsurface. Instead, a flat surface is necessary for mounting the shutters 30 to the wall. FIGS. 4-7 illustrate the current method for mounting the shutters 30 to walls 206 having uneven surfaces such as wood siding 208 wherein an additional support frame 210 is provided to secure the shutters 30 to the wall 206. Referring to FIG. 5, the shutters 30 are mounted to the subsurface 212 by removing a portion of the siding planks 208 forming the external protective surface. In the present example, portions of the pieces of siding 208 around the opening 200 and the frame 204 are cut away to expose the corresponding portion of the subsurface 212. With the external surface removed, the support frame 210 is used to mount the shutter 30 to the subsurface 212 as shown in FIG. 6, and provides clearance from the window frame 204 so the shutter 30 may be lowered over the opening 200. As best seen in FIG. 7, the support frame 210 is recessed in the cut away opening through the siding 208 and rests against the subsurface 212. The support frame 210 is secured to the subsurface 212 and/or the interior framing 214 surrounding the opening 200 by appropriate fasteners 216, and the shutter housing and side tracks 60 are secured to the support frame 210. Similar installations may also be required where the exterior surface of a wall is flat but the material from which the exterior surface is fabricated is brittle such that the shutter housing and side tracks 60 may cause the material to crack or crumble when the rolling protective shutter is mounted tightly against the surface.

As discussed above, the exterior surface protects the subsurface from the elements. Once the exterior surface is pierced and a portion removed to accommodate the frame, the protection provided by the exterior surface is compromised. The exposed portions of the subsurface are now vulnerable to the elements. Also, the edges of the siding planks are exposed to the wind which can potentially pull the siding away from the subsurface. Consequently, once the shutter and/or the frame are installed, careful attention is required to reestablish the protection for the subsurface and prevent the loss of integrity of the structure. Such attention can be time consuming, expensive, and can even damage the structure that the shutters are intended to protect if not performed properly. For these reasons, a need exists for an improved method for installing rolling shutters on uneven surfaces that does not compromise the integrity of the structure.

SUMMARY OF THE INVENTION

In one aspect, the invention is directed to a rolling shutter assembly for covering an opening in a wall of a structure having an external protective surface, an underlying support surface and a subsurface disposed therebetween. The assembly may include a shutter housing, a shutter support member rotatably disposed within the shutter housing, a shutter coupled to the shutter support member, and a pair of side tracks. The assembly may further include a plurality of dowels each having a first end, and second end, a length, a diameter and a longitudinal opening extending therethrough. The wall may have a plurality of holes through the external protective surface on either side of opening configured to receive the first ends of the dowels so that the first ends of the dowels may be inserted into corresponding holes of the external protective surface, and the side tracks may each have holes therethrough corresponding to holes through the external protective surface such that the dowels and the corresponding holes through the side tracks and the external protective surface may be aligned when the first ends of the dowels are inserted into the holes through the external protective surface and the side tracks are disposed on either side of the opening at the second ends of the dowels. A plurality of fasteners may be provided, wherein each fastener may be inserted through one of the holes through the side tracks and through the longitudinal opening of the corresponding one of the dowels disposed in a corresponding one of the holes through the external protective surface, and may be engaged by at least one of the subsurface and the underlying support structure to secure the rolling shutter assembly around the opening of the wall.

In another aspect, the invention is directed to a method for mounting a rolling shutter assembly around an opening of a wall of a structure having an external protective surface, an underlying support structure, and a subsurface disposed therebetween. The assembly may include a shutter housing, a shutter support member rotatably disposed within the shutter housing, a shutter coupled to the shutter support member, a pair of side tracks each having a plurality of holes therethrough, and a plurality of dowels each having a first end, a second end, a length, a diameter and a longitudinal opening extending therethrough. The method may include providing a plurality of holes through the external protective surface on either side of the opening configured to receive the first ends of the dowels, and inserting the first ends of the dowels into corresponding holes of the external protective surface. The method may further include disposing the side tracks adjacent the second ends of the dowels and aligning the holes of the side tracks with the corresponding holes through the external protective surface of the wall and the dowels inserted therein, and inserting fasteners through the holes of the side tracks and the longitudinal openings of the corresponding dowels and into engagement with at least one of subsurface and the underlying support structure to secure the rolling shutter assembly around the opening of the wall.

In a further aspect, the invention is directed to an improvement in a rolling shutter assembly for covering an opening in a wall of a structure having an external protective surface, an underlying support surface and a subsurface disposed therebetween. The assembly may include a shutter housing, a shutter support member rotatably disposed within the shutter housing, a shutter coupled to the shutter support member, and a pair of side tracks. The improvement may include a plurality of dowels each having a first end, and second end, a length, a diameter and a longitudinal opening extending therethrough, wherein the wall may have a plurality of holes through the external protective surface on either side of opening configured to receive the first ends of the dowels so that the first ends of the dowels may be inserted into corresponding holes of the external protective surface. The side tracks may each have holes therethrough corresponding to holes through the external protective surface such that the dowels and the corresponding holes through the side tracks and the external protective surface may be aligned when the first ends of the dowels are inserted into the holes through the external protective surface and the side tracks are disposed on either side of the opening at the second ends of the dowels. A fastener may be inserted through each of the holes through the side tracks and through the longitudinal opening of the corresponding one of the dowels disposed in a corresponding one of the holes through the external protective surface, and may be engaged by at least one of the subsurface and the underlying support structure to secure the rolling shutter assembly around the opening of the wall.

Additional aspects of the invention are defined by the claims of this patent.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

In order to mount a rolling protective shutter to an uneven external protective surface of a building with minimal penetration of the surface and with reduced time and effort in installing the shutters and reestablishing the protection of the surface, an improved attachment mechanism including a plurality of build-out dowels is provided to secure the shutter to the structure surrounding an opening. The build-out dowels may be interposed between the subsurface of the wall and the components of the rolling protective shutter to eliminate the need for cutting out a signification portion of the external surface material. Instead, holes that need only be large enough to receive the dowels are drilled through the external surface. The dowels may be dimensioned to a length approximately equal to the maximum depth of the external surface. Configured in this way, the build-out dowels provide a support surface for attaching the rolling shutter to the wall without damaging the exterior surface while facilitating the reestablishment of protection for the subsurface of the wall.

Figure 1:
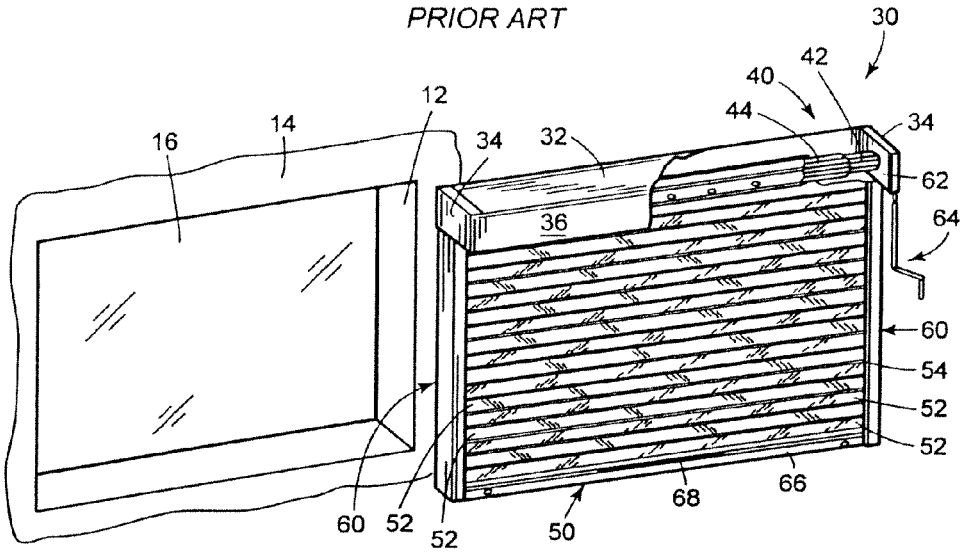
FIG. 1 PRIOR ART
FIG. 1 is a perspective view of an opening and a rolling protective shutter for covering the opening.
Figure 2:
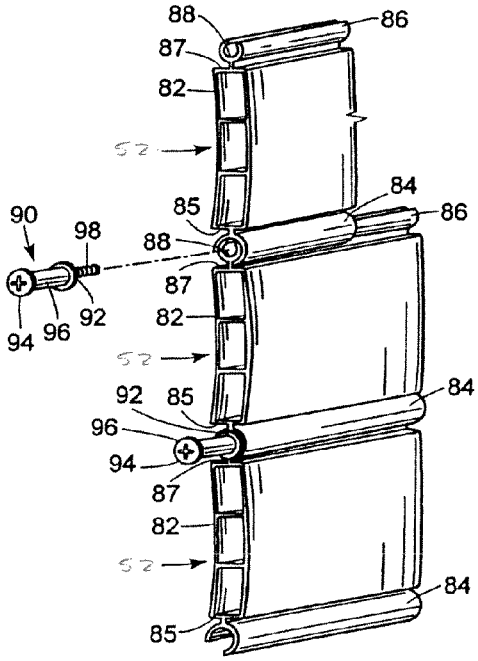
FIG. 2 PRIOR ART
FIG. 2 is a fragmentary perspective view of a shutter curtain formed by double-wall slats and including retention members for securing the ends of the slats within the side tracks of the rolling shutter assembly of FIG. 1.
Figure 3:
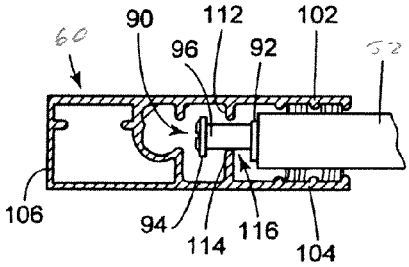
FIG. 3 PRIOR ART
FIG. 3 is a cross-sectional top view of the shutter curtain of FIG. 2 disposed within a side track of the rolling shutter assembly of FIG. 1.
Figure 4:
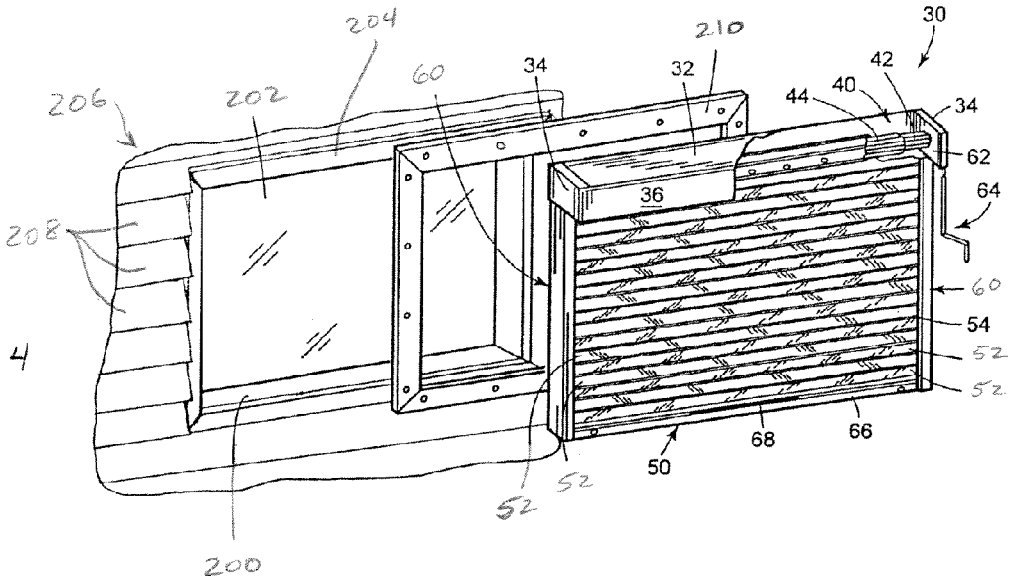
FIG. 4 is a perspective view of an opening in a wall having an exterior surface formed by siding, the rolling shutter assembly of FIG. 1 and a support frame for the rolling shutter assembly.
Figure 5:
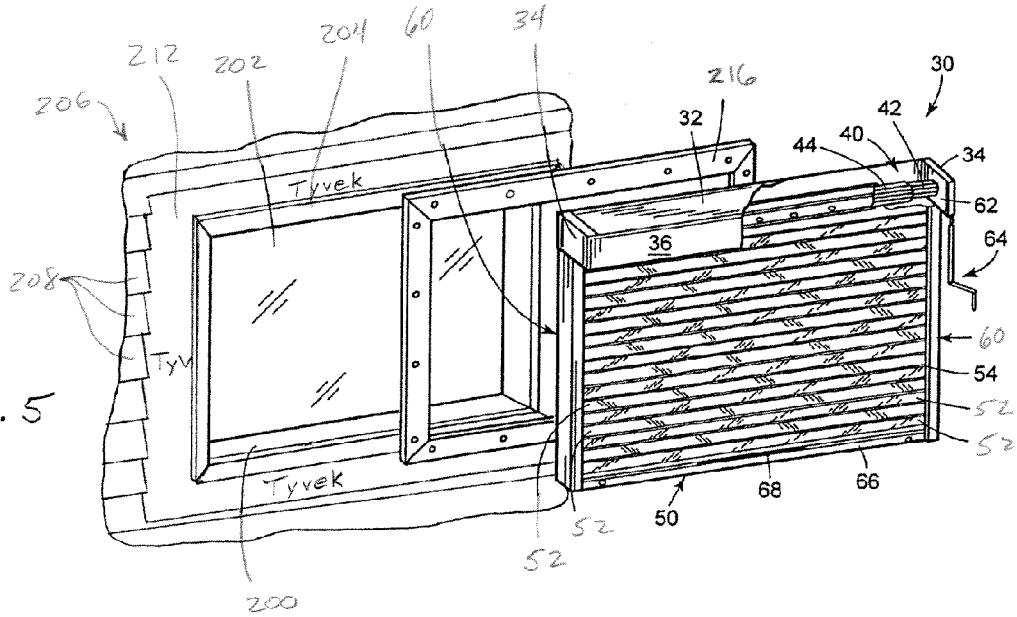
FIG. 5 is a perspective view of the wall, rolling shutter assembly and support frame of FIG. 4 with a portion of the siding around the opening removed.
Figure 6:
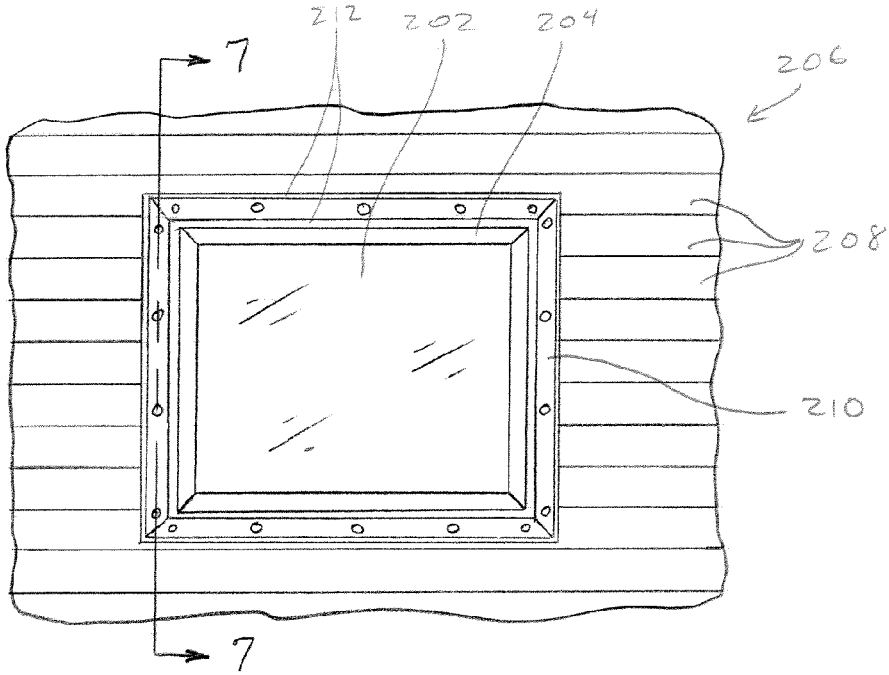
FIG. 6 is a plan view of the opening and wall of FIG. 5 with the support frame mounted to an exposed portion of the subsurface of the wall surrounding the opening.
Figure 7:
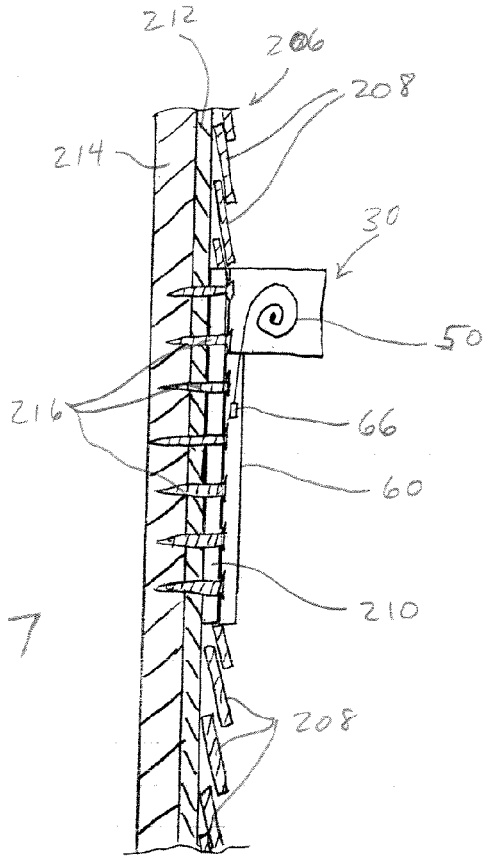
FIG. 7 is a cross-sectional side view of the wall having the rolling protective shutter and support frame of FIG. 5 mounted thereon and taken through line 7-7 of FIG. 6.
Figure 8:
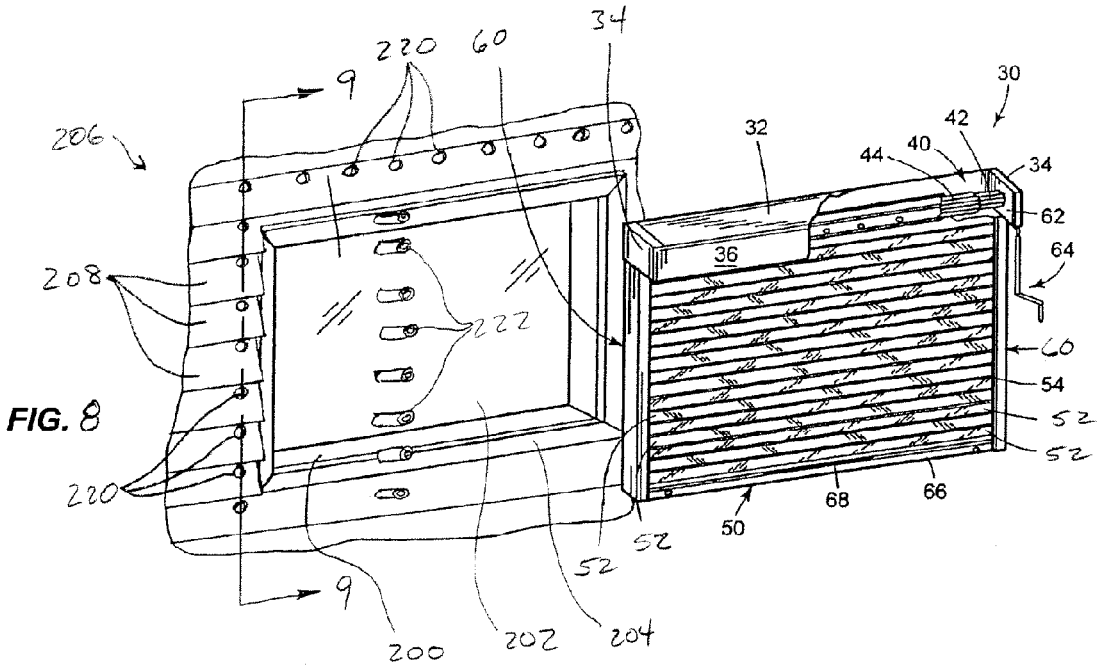
FIG. 8 is a perspective view of the wall, opening and rolling protective shutter of FIG. 4 and build-out dowels in accordance with the present disclosure.
Figure 9:
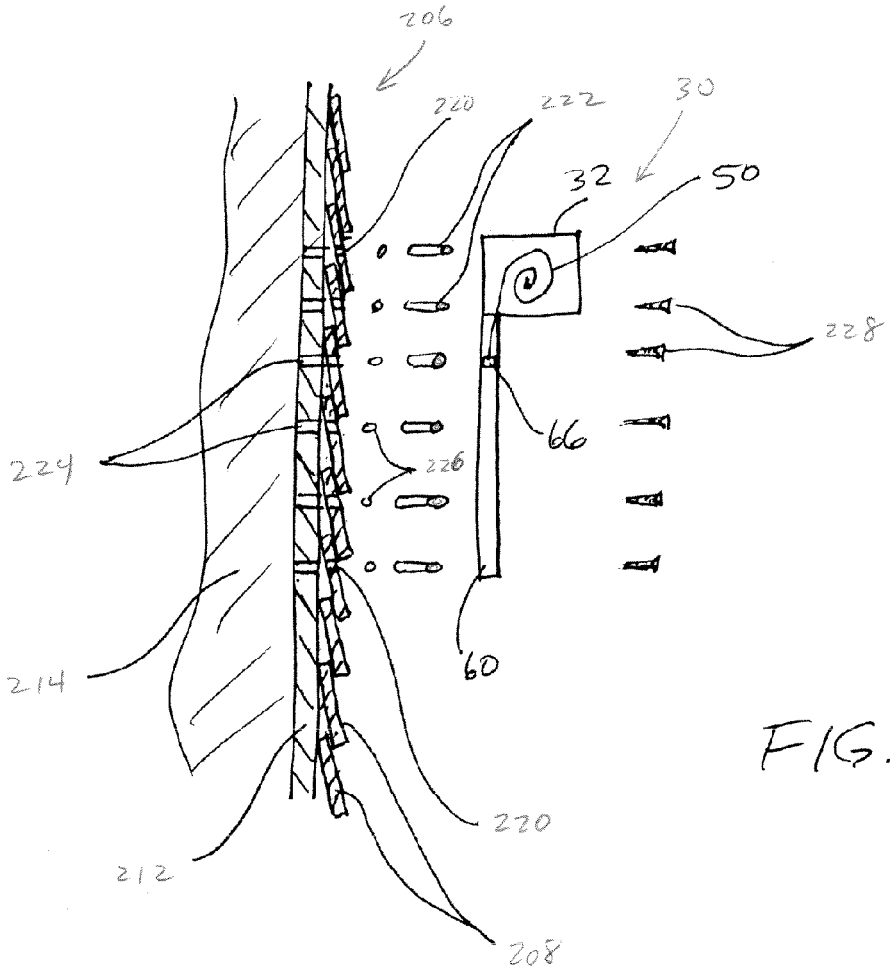
FIG. 9 is a cross-sectional exploded side view of the wall, rolling protective shutter and build-out dowels of FIG. 8 taken through line 9-9.
Figure 10:
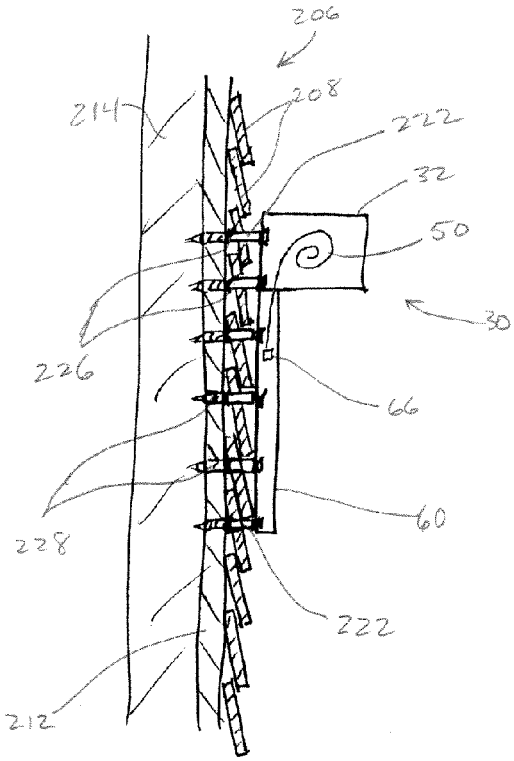
FIG. 10 is a cross-sectional side view of the wall, rolling protective shutter and build-out dowels of FIG. 8 taken through line 9-9 with the rolling protective shutter installed on the wall.

FIGS. 8-10 illustrate one embodiment of a mechanism and method for fastening a rolling protective shutter, such as the rolling protective shutter discussed above, to an uneven surface. Referring to FIG. 8, the wall 206 and opening 200 of FIG. 4 are shown along with the rolling protective shutter 30. The exterior siding planks 208 form an uneven surface around the opening 200 as discussed above. Instead of cutting out a significant portion of the siding planks 208 surrounding the opening 200 as was the case in prior installations, a plurality of holes 220 are drilled through the planks 208 to provide access to the outer surface of the subsurface layer 212. The holes 220 through the planks 208 are large enough to receive corresponding build-out dowels 222 that will be disposed therein to mount the shutter 30 to the wall 206.

Turning to FIG. 9, which is a cross-sectional view taken through the wall 206 adjacent the opening 200, and showing an exploded view of the shutter 30 and build-out dowels 222. The holes 220 through the siding planks 208 provide access to the subsurface layer 212 and the underlying support structure or framing 214 surrounding the opening 200. If necessary or desired, pilot holes 224 may be drilled through the subsurface 212. The holes 220 in the siding planks 208 may be large enough to receive the corresponding build-out dowels 222 and, if necessary, gaskets 226 that may assist in forming the seal that will protect the subsurface 212 and other structures within the wall 206. The dowels 222 may be cut or otherwise formed to a length that is approximately equal to the maximum depth of the planks 208 or other external surface material. Corresponding fasteners 228 will be inserted through the build-out dowels 222 and into the subsurface 212 to secure the shutter 30 to the wall 206.

With reference to FIG. 10, the rolling shutter 30 is shown connected to the wall 206 about the opening 200. The gaskets 226 and dowels 222 are inserted through the holes 220 in the siding planks 208 and against the outer surface of the subsurface 212. The fasteners 228 are inserted through corresponding holes of the shutter housing and side tracks 60, through the dowels 222 and gaskets 226, screwed into the subsurface 212 and, if necessary, the framing 214 around the opening 200. Once installed, the area around the dowels 222 and holes 220 may be sealed using an appropriate sealing material such as caulk, silicone sealants and the like.

The dowels 222 may be dimensioned as necessary to provide an adequate fastening surface for the shutter 30. In some implementations, the length of the dowels 222 may approximate the depth of the exterior surface 208 such that the shutter housing and side tracks 60 bear upon the exterior surface 208 to receive partial support there from, but without applying enough force to cause the exterior surface 208 to deform or crack. Alternatively, where a relatively brittle material is used for the exterior surface 208, the dowels 222 may have a length that is greater than the depth of the exterior surface 222 so that the shutter housing and side tracks 60 do not bear upon the exterior surface 208. In such installations, the dowels 222 may have a sufficient diameter and/or be provided in sufficient numbers to ensure that the shutter 30 is stable and retained during severe weather conditions without the additional support provided by direct engagement with the exterior surface 208.

Figure 11:
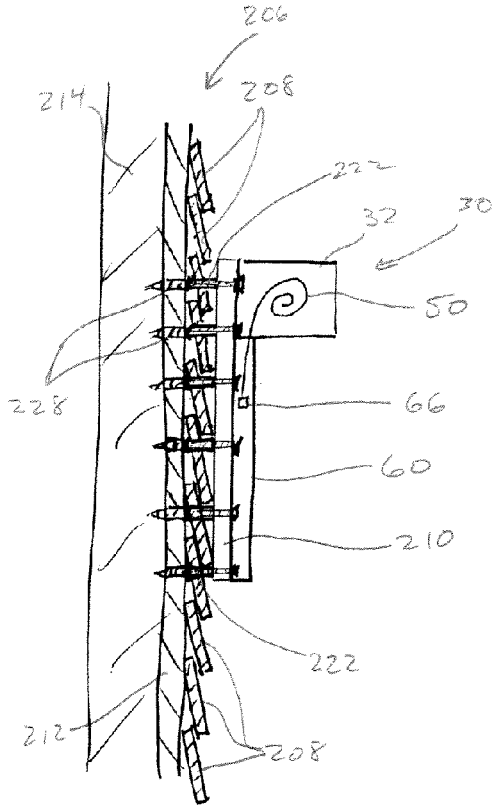
FIG. 11 is a cross-sectional side view of the wall, rolling protective shutter and build-out dowels of FIG. 8 taken through line 9-9 and a support frame installed between the build-out does and the rolling protective shutter.

Another installation condition that may require extended length dowels 222 may occur where the exterior framing 204 around the opening 206 and/or hardware for the window 202 or a door covering the opening 2006 extend beyond the uneven exterior surface 208 of the wall 206. As one alternative, the dowels 222 may be provided with a length sufficient to place the shutter housing and side tracks 60 beyond the frame 204 or other obstruction so that the shutter curtain 50 may be raised and lowered without interference. As a further alternative, the necessary spacing may be provided by installing the support frame 210 discussed above between the dowels 222 and the shutter 30. Referring to FIG. 11, the dowels 222 may have lengths approximately equal to the depth of the exterior surface 208 as discussed above. The support frame 210 may be provided with a depth sufficient to place the shutter curtain 50 beyond the frame 204 around the opening 200. Depending on the installation, the dowels 222, support frame 210 and rolling shutter 30 may be attached using a single set of fasteners 228, or the support frame 210 may be mounted to the wall 206 with a first set of fasteners 228, and the rolling shutter 30 may then be attached to the support frame 210 with a second set of fasteners 228.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A rolling shutter assembly for covering an opening in a wall of a structure having an external protective surface, an underlying support structure and a subsurface disposed therebetween, the assembly comprising:

a shutter housing;

a shutter support member rotatably disposed within the shutter housing;

a shutter coupled to the shutter support member;

a pair of side tracks, wherein lateral edges of the shutter are disposed within the side tracks when the shutter is unrolled to cover the opening, and wherein the side tracks engage the corresponding lateral edges of the shutter to retain the lateral edges within the side tracks;

a plurality of dowels each having a first end, and second end, a length, a diameter and a longitudinal opening extending therethrough, wherein the wall has a plurality of holes through the external protective surface on either side of opening configured to receive the first ends of the dowels so that the first ends of the dowels may be inserted into corresponding holes of the external protective surface, and wherein the side tracks each have holes therethrough corresponding to holes through the external protective surface such that the dowels and the corresponding holes through the side tracks and the external protective surface may be aligned when the first ends of the dowels are inserted into the holes through the external protective surface and the side tracks are disposed on either side of the opening at the second ends of the dowels; and a plurality of fasteners, wherein each fastener is inserted through one of the holes through the side tracks and through the longitudinal opening of the corresponding one of the dowels disposed in a corresponding one of the holes through the external protective surface, and the plurality of fasteners directly engage at least one of the subsurface and the underlying support structure to secure the rolling shutter assembly around the opening of the wall.

2. A rolling shutter assembly as defined in claim 1, wherein the plurality of fasteners directly engage the underlying support structure of the wall.

3. A rolling shutter assembly as defined in claim 1, wherein the length of the dowels is at least equal to a maximum depth of the external protective surface of the wall.

4. A rolling shutter assembly as defined in claim 1, comprising a plurality of gaskets, each gasket being disposed between the first end of one of the dowels and a corresponding portion of the subsurface.

5. A rolling shutter assembly as defined in claim 1, wherein the wall has a plurality of additional holes through the external protective surface above the opening on either side of opening configured to receive the first ends of the dowels so that the first ends of the dowels may be inserted therein, and wherein the shutter housing has holes therethrough corresponding to the additional holes through the external protective surface such that the dowels and the corresponding holes through the shutter housing and the external protective surface may be aligned when the first ends of the dowels are inserted into the holes through the external protective surface and the side tracks are disposed on either side of the opening at the second ends of the dowels.

6. A rolling shutter assembly as defined in claim 1, wherein the wall has a plurality of additional holes through the external protective surface above the opening configured to receive the first ends of the dowels so that so that the dowels may be inserted therein, and wherein the shutter housing has holes therethrough corresponding to the additional holes through the external protective surface such that the dowels and the corresponding holes through the shutter housing and the external protective surface may be aligned when the first ends of the dowels are inserted into the holes through the external protective surface and the side tracks are disposed on either side of the opening at the second ends of the dowels.

7. A rolling shutter assembly as defined in claim 1, comprising a support frame having a top rail, a bottom rail and a pair of oppositely disposed side rails, wherein the side rails each include a plurality of holes corresponding to the holes through the external protective surface of the wall and through the side tracks, wherein the support frame is disposed between the second ends of the dowels and the side tracks with the holes through the side rails aligning with the corresponding openings through the dowels and holes through the side tracks and the external protective surface with the fasteners passing therethrough.

8. A method for mounting a rolling shutter assembly around an opening of a wall of a structure having an external protective surface, an underlying support structure, and a subsurface disposed therebetween, wherein the assembly comprises a shutter housing, a shutter support member rotatably disposed within the shutter housing, a shutter coupled to the shutter support member, a pair of side tracks each having a plurality of holes therethrough, and a plurality of dowels each having a first end, a second end, a length, a diameter and a longitudinal opening extending therethrough, the method comprising:

providing a plurality of holes through the external protective surface on either side of the opening configured to receive the first ends of the dowels;

inserting the first ends of the dowels into corresponding holes of the external protective surface;

disposing the side tracks adjacent the second ends of the dowels and aligning the holes of the side tracks with the corresponding holes through the external protective surface of the wall and the dowels inserted therein; and inserting fasteners through the holes of the side tracks and the longitudinal openings of the corresponding dowels and into direct engagement with at least one of subsurface and the underlying support structure to secure the rolling shutter assembly around the opening of the wall.

9. A method as defined in claim 8, comprising directly anchoring the fasteners in the underlying support structure of the wall.

10. A method as defined in claim 8, wherein the length of the dowels is at least equal to a maximum depth of the external protective surface of the wall.

11. A method as defined in claim 8, wherein the rolling shutter assembly includes a plurality of gaskets, the method comprising inserting the gaskets into the holes of the external protective surface before inserting the first ends of the dowels such that the gaskets are disposed between the first ends of the dowels and the subsurface of the wall.

12. A method as defined in claim 8, comprising:

providing a plurality of additional holes through the external protective surface above the opening on either side of the opening configured to receive the first ends of the dowels;

providing a plurality of holes in the shutter housing corresponding to the additional holes through the external protective surface;

inserting first ends of dowels into the additional holes through the external protective surface; and inserting fasteners through the holes of the shutter housing and the longitudinal openings of the dowels in the corresponding additional holes through the external protective surface, and into direct engagement with at least one of the subsurface and the underlying support structure to secure the shutter housing above the opening of the wall.

13. A method as defined in claim 8, comprising:

providing a plurality of additional holes through the external protective surface above the opening configured to receive the first ends of the dowels;

providing a plurality of holes in the shutter housing corresponding to the additional holes through the external protective surface;

inserting first ends of dowels into the additional holes through the external protective surface; and inserting fasteners through the holes of the shutter housing and the longitudinal openings of the dowels in the corresponding additional holes through the external protective surface, and into direct engagement with at least one of the subsurface and the underlying support structure to secure the shutter housing above the opening of the wall.

14. A method as defined in claim 8, wherein the shutter assembly includes a support frame having a top rail, a bottom rail, and a pair of oppositely disposed side rails, the method comprising:

providing a plurality of holes in the side rails of the support frame corresponding to the plurality holes through the external protective surface of the wall and through the side tracks;

disposing the support frame between the second ends of the dowels and the side tracks with the holes through the side rails aligning with the corresponding openings through the dowels and holes through the side tracks and the external protective surface with the fasteners being inserted therethrough.

15. In a rolling shutter assembly for covering an opening in a wall of a structure having an external protective surface, an underlying support structure and a subsurface disposed therebetween, the assembly having a shutter housing, a shutter support member rotatably disposed within the shutter housing, a shutter coupled to the shutter support member, and a pair of side tracks, wherein lateral edges of the shutter are disposed within the side tracks when the shutter is unrolled to cover the opening, and wherein the side tracks engage the corresponding lateral edges of the shutter to retain the lateral edges within the side tracks, the improvement comprising:

a plurality of dowels each having a first end, and second end, a length, a diameter and a longitudinal opening extending therethrough, wherein the wall has a plurality of holes through the external protective surface on either side of opening configured to receive the first ends of the dowels so that the first ends of the dowels may be inserted into corresponding holes of the external protective surface, wherein the side tracks each have holes therethrough corresponding to holes through the external protective surface such that the dowels and the corresponding holes through the side tracks and the external protective surface may be aligned when the first ends of the dowels are inserted into the holes through the external protective surface and the side tracks are disposed on either side of the opening at the second ends of the dowels, and wherein a fastener is inserted through each of the holes through the side tracks and through the longitudinal opening of the corresponding one of the dowels disposed in a corresponding one of the holes through the external protective surface, and the fasteners directly engage at least one of the subsurface and the underlying support structure to secure the rolling shutter assembly around the opening of the wall.

16. A rolling shutter assembly as defined in claim 15, wherein the fasteners directly engage the underlying support structure of the wall.

17. A rolling shutter assembly as defined in claim 15, wherein the length of the dowels is at least equal to a maximum depth of the external protective surface of the wall.

18. A rolling shutter assembly as defined in claim 15, the improvement comprising a plurality of gaskets, each gasket being disposed between the first end of one of the dowels and a corresponding portion of the subsurface.

19. A rolling shutter assembly as defined in claim 15, wherein the wall has a plurality of additional holes through the external protective surface above the opening on either side of opening configured to receive the first ends of the dowels so that the first ends of the dowels may be inserted therein, and wherein the shutter housing has holes therethrough corresponding to the additional holes through the external protective surface such that the dowels and the corresponding holes through the shutter housing and the external protective surface may be aligned when the first ends of the dowels are inserted into the holes through the external protective surface and the side tracks are disposed on either side of the opening at the second ends of the dowels.

20. A rolling shutter assembly as defined in claim 15, wherein the wall has a plurality of additional holes through the external protective surface above the opening configured to receive the first ends of the dowels so that so that the dowels may be inserted therein, and wherein the shutter housing has holes therethrough corresponding to the additional holes through the external protective surface such that the dowels and the corresponding holes through the shutter housing and the external protective surface may be aligned when the first ends of the dowels are inserted into the holes through the external protective surface and the side tracks are disposed on either side of the opening at the second ends of the dowels.

21. A rolling shutter assembly as defined in claim 15, the improvement comprising a support frame having a top rail, a bottom rail and a pair of oppositely disposed side rails, wherein the side rails each include a plurality of holes corresponding to the holes through the external protective surface of the wall and through the side tracks, wherein the support frame is disposed between the second ends of the dowels and the side tracks with the holes through the side rails aligning with the corresponding openings through the dowels and holes through the side tracks and the external protective surface with the fasteners passing therethrough.

* * * * *